US005522574A

United States Patent [19]

Maglione

[11] Patent Number: 5,522,574

[45] Date of Patent: Jun. 4, 1996

[54] COLLAPSIBLE DISPLAY STAND

[76] Inventor: Stephen T. Maglione, 15 Ava Maria Ct., Millington, N.J. 07946

[21] Appl. No.: 291,129

[22] Filed: Aug. 16, 1994

[51] Int. Cl.[6] ..... F16M 13/00

[52] U.S. Cl. ..... 248/174; 248/220.31

[58] Field of Search ..... 248/174, 459, 248/220.41, 224.4, 220.31, 152, 220.42, 220.43, 220.21; 211/135

[56] References Cited

U.S. PATENT DOCUMENTS

| | | | |
|---|---|---|---|
| 1,495,864 | 5/1924 | Miller | 248/459 |
| 1,565,026 | 12/1925 | Moore | 248/174 |
| 1,902,566 | 3/1933 | Marsh | 248/174 X |
| 2,146,421 | 1/1939 | Davidson | 248/174 X |
| 2,797,815 | 7/1957 | Gorman | 248/152 X |
| 3,433,365 | 3/1969 | Hodson | 248/220.3 |
| 3,438,508 | 4/1969 | Kuns et al. | 248/174 X |
| 3,494,479 | 2/1970 | Martin | 248/174 X |
| 3,850,396 | 11/1974 | Orlandi | 248/221.1 |
| 3,871,608 | 3/1975 | Ogden . | |
| 4,311,233 | 1/1982 | Austin . | |
| 4,671,417 | 6/1987 | O'Brien . | |
| 4,687,128 | 8/1987 | White . | |
| 4,813,536 | 3/1989 | Willis et al. . | |
| 4,860,905 | 8/1989 | Schott et al. . | |
| 5,305,875 | 4/1994 | Meyer . | |

*Primary Examiner*—Karen J. Chotkowski

[57] ABSTRACT

A display stand formed from a blank single corrugated sheet has a shelf supported by a depending front wall hinged to the shelf front edge and a rear upstanding wall hinged to the shelf at a rear fold hinge. Two mirror image opposite side walls form a U-shaped member with the front wall, each side wall comprising overlapping inner and outer panels folded over at a fold hinge and formed with a slot. The rear wall is formed with two mating slots, one for each side wall slot which slots interlock to support the rear wall and shelf at the rear of the stand. The front and side walls form a support edge for the stand. The rear upstanding wall is formed of folded over sheets with a front sheet formed with linear arrays of discrete article support peg receiving apertures and a pair of coplanar rear sheets each formed with linear slots aligned with the apertures to facilitate insertion of pegs through the apertures and rear sheets. The front and rear sheets provide double thickness support for the inserted pegs.

24 Claims, 4 Drawing Sheets

FIG. 3
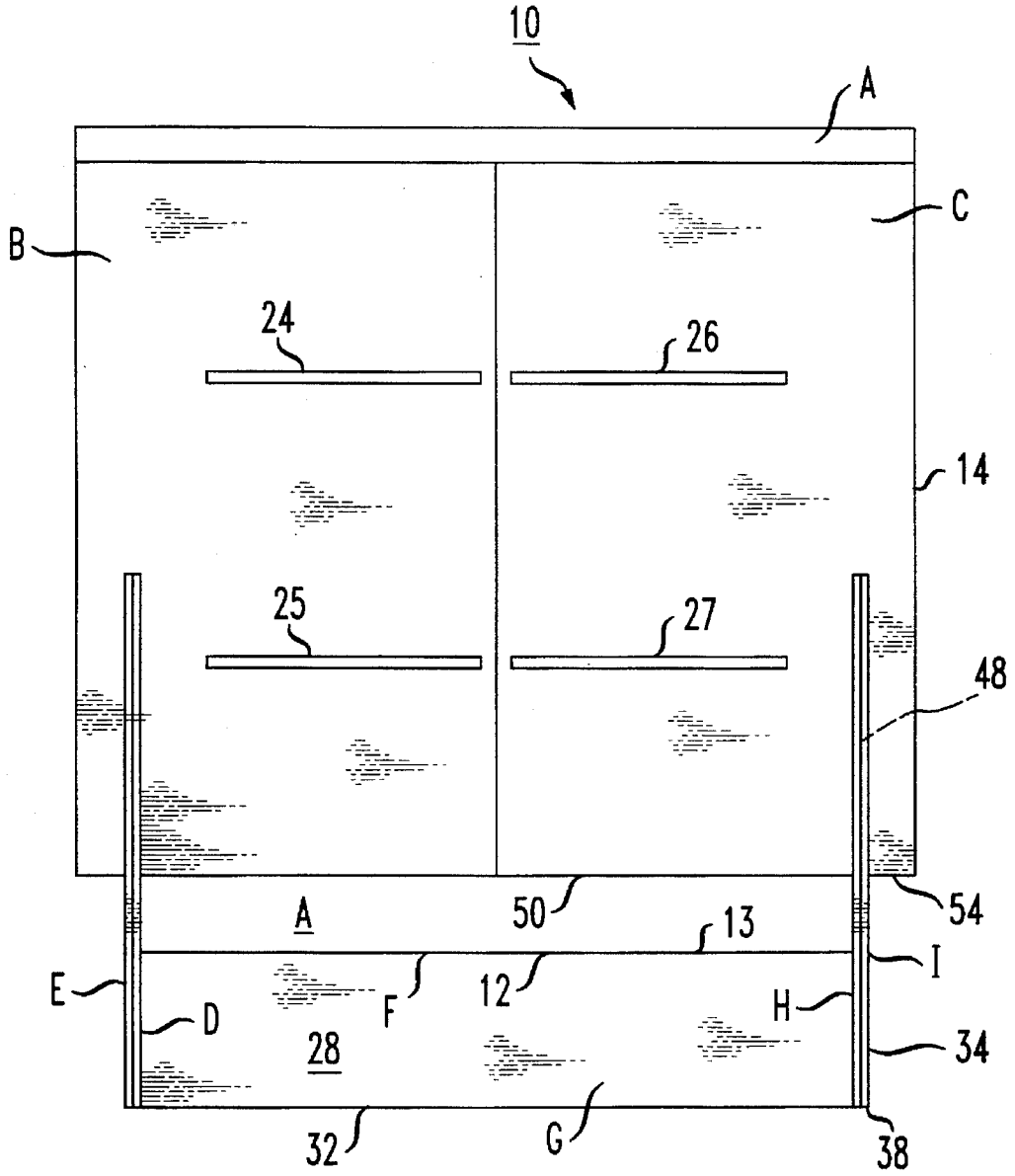
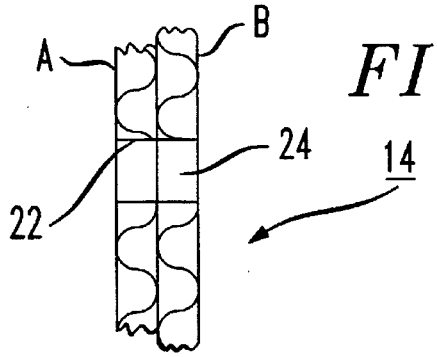
FIG. 3a

COLLAPSIBLE DISPLAY STAND

FIELD OF THE INVENTION

This invention relates to collapsible display stands, in particular, paperboard stands.

BACKGROUND OF THE INVENTION

Collapsible display stands made of corrugated paperboard are in wide use. There are numerous different configurations available, each designed to meet a given need. For example, U.S. Pat. No. 4,311,233 discloses one type of display useful for displaying cartons as illustrated in FIG. 9 thereof. This is an easel type display in which the rear upright wall is tilted rearwardly. As a result a rear support flap is included. The base of the display forms a bottom wall for supporting the display stand and forms a product carton receiving cavity with a lower front wall and trapezoidal side walls and the rear wall. The side walls include interior panels which normally are hidden by the product on display, but when exposed can be unsightly. This package is not designed to display relative small articles, such as for use on a counter, for example, but relatively large product cartons as shown.

U.S. Pat. No. 5,305,875 illustrates and discloses another type of fold-up display container. This is similar in some respects to the display discussed above in that it too has a bottom cavity formed by front, side and rear walls, with an upstanding rear wall extending above the cavity. This display is designed for standing on a support or for hanging with hanging apertures provided. The walls are all interlocked in the display configuration. This container is designed to display printed material and is formed of plastic molded material. Front feet elevate the display to tilt it.

U.S. Pat. No. 3,871,608 discloses an apertured display board for receiving brackets with legs extending through the apertures for supporting the brackets on the board. The brackets have tortuous leg portions which pass through the apertures to hold the brackets in place. A back support for the board is provided to form the board into a stand or eyelets provided to hang the board.

U.S. Pat. Nos. 4,671,417 and 4,480,905 disclose still other display arrangements using hooks and similar support members for displaying products.

U.S. Pat. No. 4,687,128 discloses a still different display arrangement in which a corrugated board display structure has tabs for connecting shelf to an upright support. U.S. Pat. No. 4,813,536 discloses a shipping container and display stand with a separate advertising panel which is attached to the display.

SUMMARY OF THE INVENTION

The present inventor recognizes a need for a display articles, such as a counter display for small articles which can display the articles on a shelf and on a peg board arrangement and wherein the display has a neat attractive appearance with no unsightly paperboard edges showing from the display front portion. A collapsible display stand according to an embodiment of the present invention comprises a planar shelf forming an article support surface and a periphery comprising a front edge, two opposite side edges and a rear edge. A front wall is secured to and depends from the shelf front edge at a first hinge fold. A rear wall upstands from and secured to the shelf rear edge at a second hinge fold. A pair of like spaced side walls are each secured to the front wall and releasably secured to the rear wall, the side walls and front wall forming a support for the shelf and rear wall, the side walls and front wall each having a lower edge distal the shelf forming a support plane wherein the shelf and rear wall are spaced from the plane.

In accordance with a further embodiment, the rear wall includes a plurality of article support peg receiving apertures. In accordance with a still further embodiment, the rear wall comprises a front sheet member and an overlying rear sheet member secured to the front sheet member, the front member having a plurality of apertures therethrough, the rear sheet member having a slot therethrough aligned with the apertures, the slot permitting the insertion of a peg through an aperture to thereby provide further support for the inserted article support peg.

In accordance with a further embodiment, a pegboard display comprises a first sheet member with a peg receiving aperture therethrough and a second sheet member secured to and overlying the first sheet member, the second sheet member including means aligned with the peg receiving aperture for supporting the inserted peg.

IN THE DRAWING

FIG. 3 is a rear elevation view of the stand of FIG. 1;

Figure 1:
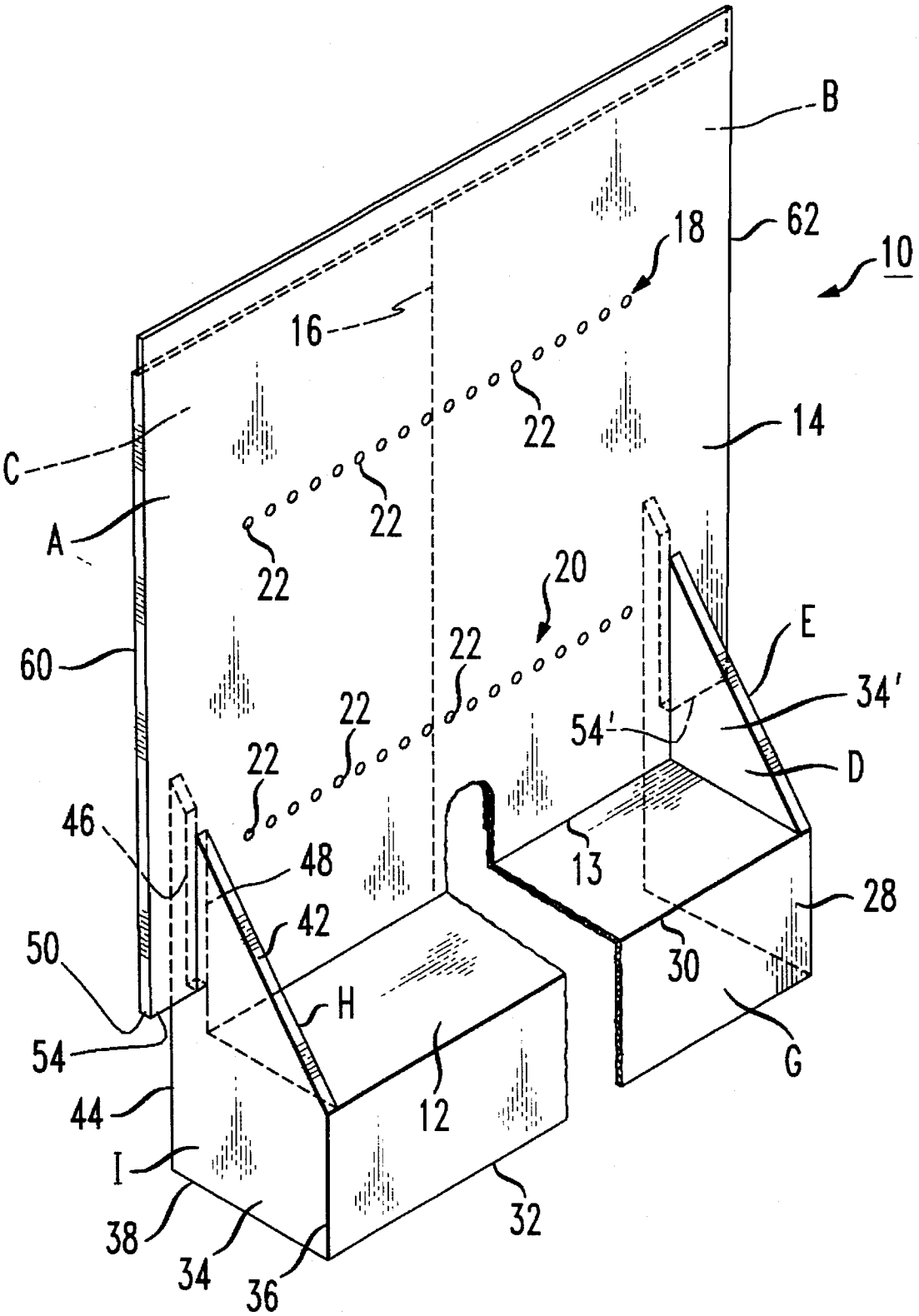
FIG. 1 is an isometric view of a display stand in accordance with one embodiment of the present invention.
Figure 4:
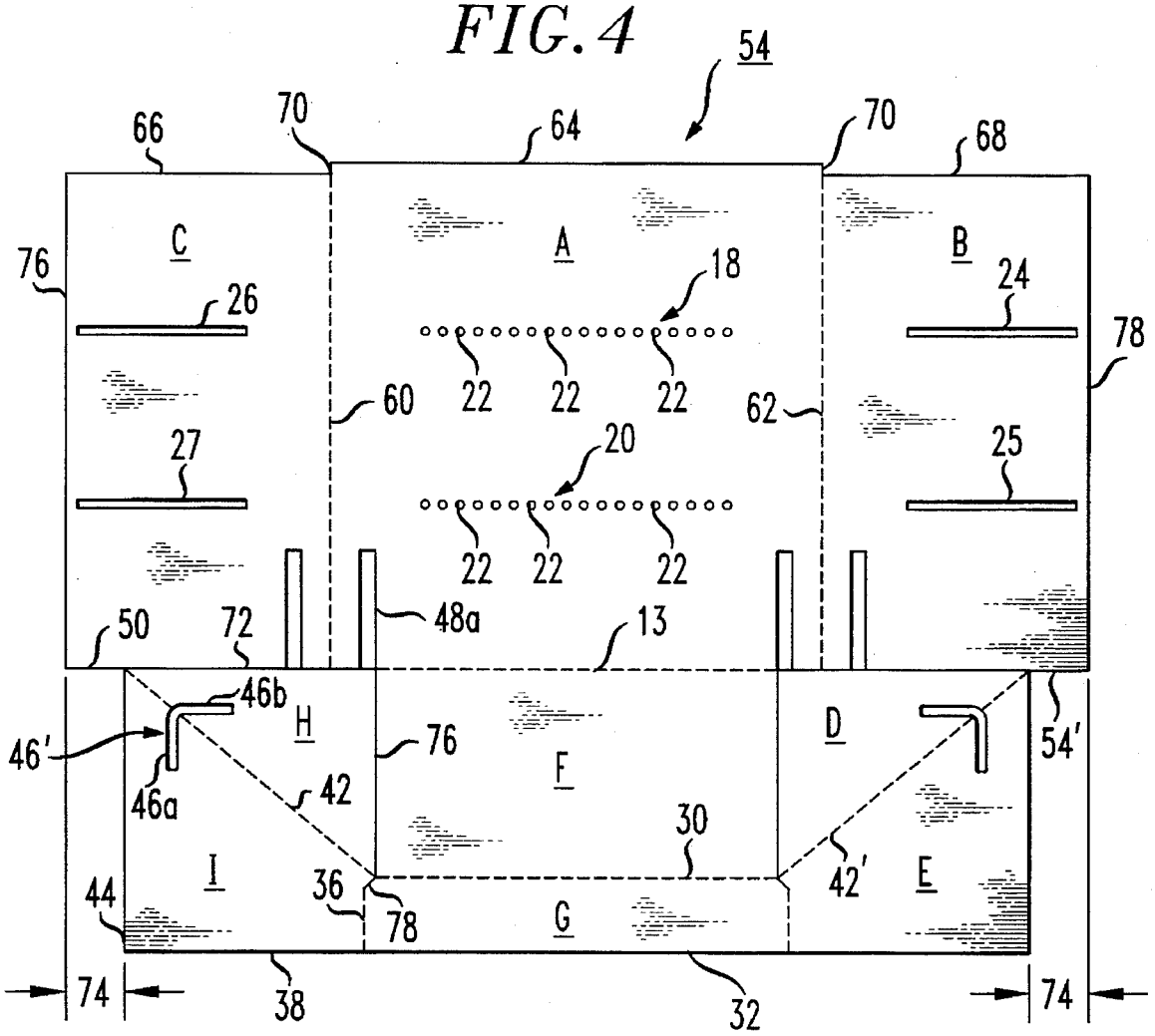
Figure 5:
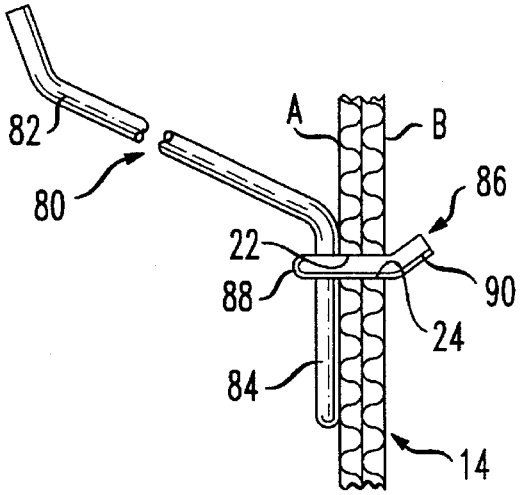
Figure 6:
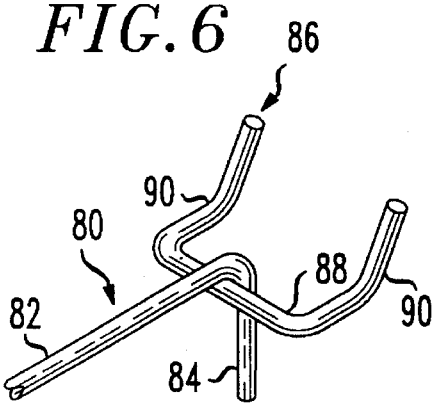

FIG. 3*a* is a sectional side elevation view through the rear wall at a peg receiving aperture of the stand of FIG. 1;

FIG. 4 is a plan view of a blank sheet of material used to fabricate the stand of FIG. 1;

FIG. 5 is a side elevation sectional view of the stand of the present invention illustrating an article support peg inserted into an article support aperture of the stand of FIG. 1; and FIG. 6 is an isometric fragmented view of the peg of FIG. 5.

DESCRIPTION OF THE PREFERRED EMBODIMENTS

Figure 2:
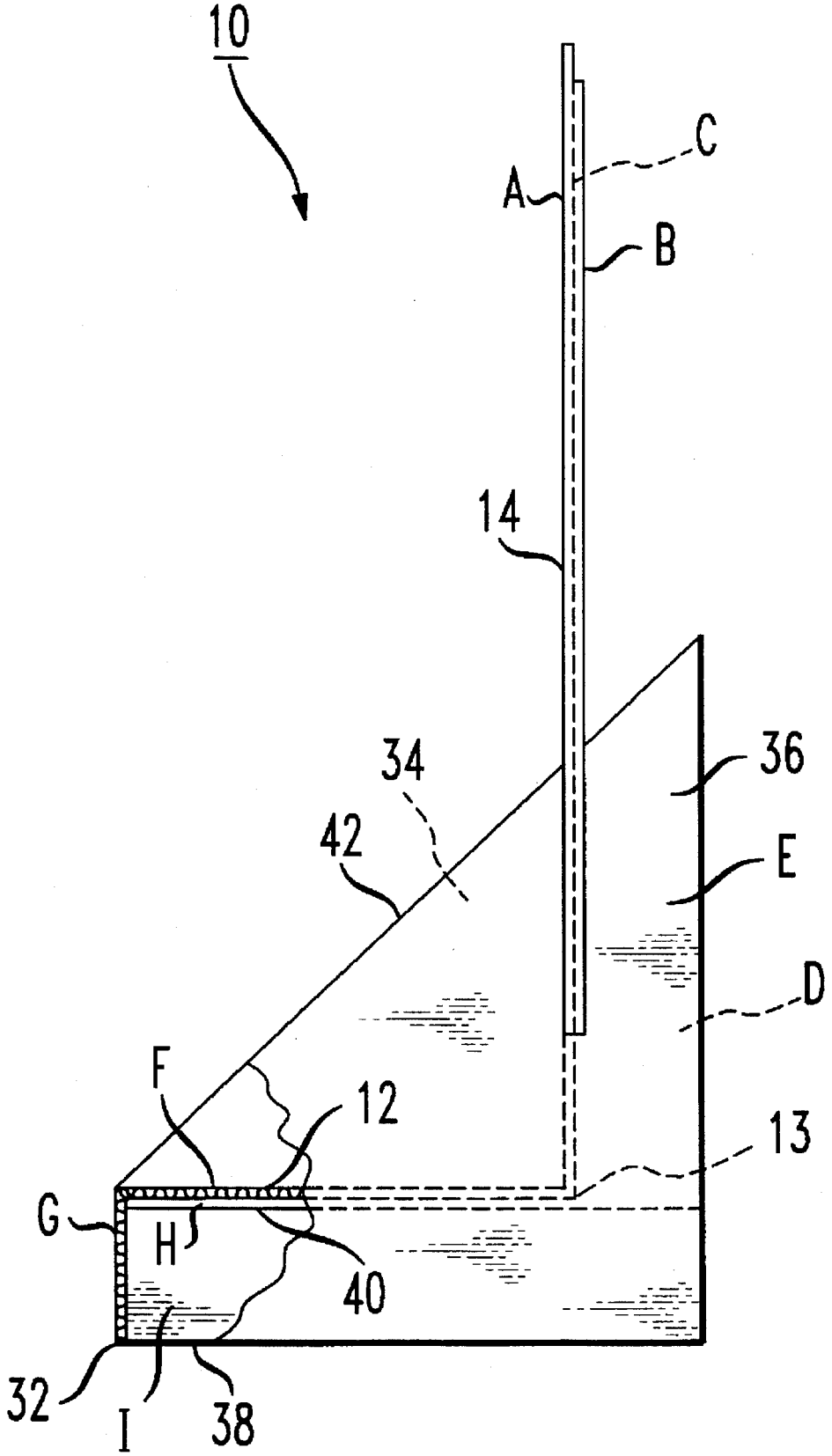
FIG. 2 is a side elevation view of the stand of FIG. 1 partially in section.

IN FIGS. 1, 2 and 3, stand 10 comprises a single sheet material paperboard structure preferably corrugated, and which also could be thermoplastic material or any other foldable relatively stiff sheet material. While the stand could be metal, such is not typically used for such stands. The various panels forming the stand from a blank sheet of corrugated paper board are designated by the reference letters A–I. The blank will be described below in connection with FIG. 4.

The stand has a generally horizontal shelf 12 formed by panel F. The shelf 12 at its rear edge has a fold hinge 13. Upstanding from hinge 13 is rear wall 14. The fold hinge 13 may be formed by spaced perforations or a linear depression in the material. The shelf may also be slightly inclined upwardly toward the rear wall 14. The rear wall comprises a front panel A and two mirror image like rear panels B and C overlapping the front panel A and bonded to the front panel by an adhesive. A vertical seam is formed by the abutting rear panels B and C. Two generally horizontal (with respect to the force of gravity when the stand is in use) linear arrays 18 and 20 of like peg receiving apertures 22 are formed in panel A only. The apertures 22, preferably circular cylindrical, pass through the panel A. The apertures of the different arrays may also be of different sizes and shapes according to a given implementation.

In FIGS. 3 and 3*a*, the panel B has linear slots 24–25 therethrough and the panel C has linear like slots 26–27 therethrough. The slots 24 and 26 are aligned on a line and with the array 18 of apertures 22 on the front panel A. The slots 25 and 27 are aligned on a line and with the array 20 of apertures 22 on the front panel A. The arrays 18 and 20 are preferably symmetrical with respect to the seam 16 and wall 14, but this is not essential. The slots 24–27 provide a continuous through aperture with the apertures 22 as shown for example in FIG. 3*a* with representative slot 24.

Slots 24–27 have a given transverse width corresponding to the diameter of the apertures 22 as shown in FIG. 3*a*. They also may have a greater or smaller transverse width in accordance with a given implementation. For example, in the alternative to the slots shown, the slots 24–27 may be replaced by cuts of negligible transverse width. These cuts are aligned with apertures 22. Cuts are not as desireable because pegs generally of about the same diameter as the apertures 22 inserted through the apertures 22 and such cuts tend to tear, bend or otherwise damage the rear panels at the cut region. This damage, which is unsightly, might be acceptable in certain implementations. Therefore, the term "slot" as used in the claims includes cuts of negligible transverse width and slots of finite transverse width. That is, the slots aligned with the apertures 22 may have a transverse width that may be smaller or larger than the diameter of the apertures 22. When smaller, the rear panels must be of such material, e.g., paperboard, that will bend or deflect to permit a peg to be inserted therethrough.

In FIG. 1, front wall 28 is formed by panel G which is hinged to shelf 12 by fold hinge 30. The wall 28 depends vertically downward and has a stand support edge 32. Side walls 34 and 34' are identical in mirror image fashion and only one will be described as being representative. Side wall 34 is secured to the front wall 28 by vertical fold hinge 36. Wall 34 has a trapezoidal shape with a stand support edge 38 coplanar with edge 32. Wall 34 comprises panels H and I. Panel I is external the stand and of the trapezoidal shape. Panel H is interior and overlies panel I. Panel H is triangular in shape and has a lower edge 40 which depends beneath the shelf 12. The panel H is joined to panel I by a fold hinge 42. The fold hinge 42 is inclined and extends from hinge 36 at shelf front hinge 30 upwardly to rear edge 44 of wall 34.

The wall 34 has a vertical slot 46 in communication with and intersecting hinge 42. Slot 46 is engaged with a mating slot 48 in the rear wall 14. Slot 48 is in communication with and intersects the lower edge 50 of the rear panel C and combined lower edges of the front and rear panels A and C at shoulder 54. The front panel A abuts the inner side of inner panel H. The slot 46 closely receives the panels A and C of the rear wall 14 and the slot 48 closely receives the panels H and I. Shoulder 54 is formed by panels A and C being wider in the upper portion of the rear wall 14 than shelf 12.

In FIG. 4, the blank 54 of corrugated sheet paperboard material forming the stand 10 comprises the panels A–I as discussed above, all formed from and connected as a single sheet of material. The dashed lines in the figure represent the fold hinges. The solid lines within the material body represent cuts completely through the sheet of material.

Panel A is joined to panel C by fold hinge 60 and to panel B by fold hinge 62. Panel A has an upper edge 64 stepped above the upper edges 66 and 68, respectively, of the panels C and B at shoulders 70. The lower edge 50 of panel C is formed partially by cut 72 and a projecting shoulder 54 in region 74. The slot 48 (FIG. 1) in the rear wall 14 is formed by slots 48*a* and 48*b* in respective panels A and C. Identical slots 48*a* and 48*b* are formed in panels A and B at the opposite side of panel A. The cut 72 continues until it intersects the slot 48*a*.

The shelf 12 formed by panel F as mentioned above is formed by hinged folds 13 and 30 at the respective opposite sides of the panel F. A cut 76 forms lower edge 40 (FIG. 2) of panel H and separates panel H from the shelf panel F. The fold hinge 42 completes the formation of panel H with the cut 72. The cut 76 inclines at 78 with respect to the rest of the cut, which is linear, to allow for the thickness of the folded over panels H and I at hinge 30, and terminates aligned with and at hinge 36. The cut 76 is also aligned with the inner edge of the slot 48*a*. The slots 48*a* and 48*b*, when the panels A and C are folded over at hinge 60, form slot 48. The panel I is formed by edges 38 and 44 and hinges 36 and 42. A right angle slot 46' is formed with a leg 46*a* in panel I and a leg 46*b* at right angles to leg 46*a* in panel H. The legs 46*a* and 46*b* form slot 46 when the panels H and I are folded over in the overlying position of FIG. 1.

To assemble the blank 54 into the stand 10 of FIG. 1, the panel C is folded at hinge 60 over the rear of front panel A. The panel B is similarly folded over at hinge 62 with edges 76 and 78 abutting and forming seam 16, FIG. 1. These panels are then bonded to each other over their entire surface. The slots 24 and 26 are aligned linearly over aperture array 18 and the slots 25 and 27 are aligned linearly over aperture array 20. The slots 24–27 preferably terminate spaced slightly from the respective edges 76 and 78.

Panel H is then folded over at hinge 42 to form wall 34 and the panel D is folded over at hinge 42' to form the corresponding wall 34' on the opposite side of the display stand 10. This also forms slot 46 in each of the side walls. The two overlying panels H and I are then folded at hinge 36 until panel H abuts the cut 76 edge of the shelf 12 panel F. The wall 34' on the other side of the display stand 10 is formed similarly. At this time, the walls 34 and 34' form the legs and the front wall 28 forms the base of a U-shaped member hinged to the shelf at hinge 30.

During this folding action the slot 46 is then engaged with the slot 48 of the rear wall 14 to interlock the walls 34 and 14 together. The corresponding wall 34' on the stand other side is similarly formed and assembled to the rear wall 14 at their mating slots corresponding to slots 46 and 48.

When the walls 34 and 34' are interlocked to the rear wall, the walls 34 and 34' support the rear wall and indirectly the shelf 12 adjacent to the rear wall which is attached to the shelf 12 by the hinge 13. Thus the shelf is supported at the front by wall 28 and indirectly at the rear by the interlocked engagement of the rear wall with the side walls. The shelf 12 is not supported in the intermediate region between the front and rear walls. However, the shelf material is such that the shelf is relatively stiff and strong for supporting articles to be displayed thereon, if so desired. Preferably, the articles to be displayed are only hung from pegs.

In FIGS. 5 and 6, a peg 80 is attached to the rear wall 14 in an aperture 22, which is circular. The peg is a circular cylindrical metal wire or rod bent to have an article supporting portion which may be a hook 82 and a depending leg portion 84. Peg 80 includes a second U-shaped member 86. Member 86 is also a bent circular cylindrical wire or rod having a base portion 88 and a pair of bent legs 90. The base portion 88 is welded to the leg portion of hook 82. The peg 80 is inserted into the aperture 22 by inserting legs 90 in a pair of adjacent apertures 22 in an array 18 or 20.

The overlying panel B at slot 24 supports and assists in retaining the peg in the aperture 22 by providing an additional thickness to the rear wall, permitting an otherwise relatively thin single sheet of paperboard to be used to fabricate the stand 10. The slots 24–27 are easily aligned with the apertures without imposing a registration alignment problem as would occur if individual apertures were used in the panels B and C instead of the slots. It is much simpler to fabricate the slots and have them align with an array of apertures than to align front and rear panels discrete sheet apertures due to manufacturing tolerances. While the apertures 22 are in two linear arrays they may be in other spaced arrangements, sizes and shapes as desired. Articles to be displayed are hung from the pegs and also may be placed on the shelf 12. For example, the apertures such as apertures 22 may be in different shaped arrays, e.g., L-shaped, star shaped and so on while the slots in the rear panels B and C are provided for alignment with the front panel A apertures.

While one particular type of peg has been illustrated it will be appreciated that other peg shapes and configurations may be used. In all cases the slots 24–27 facilitate the insertion and support of the inserted pegs in a second rear sheet overlying the front sheet employing a single sheet of paperboard to fabricate the entire display stand.

Preferably, the stand 12 is dimensioned to be placed on a counter for displaying relatively small articles at the retail point of sale. However, scale is not important.

It will occur to one of ordinary skill that various modifications to the disclosed embodiments may be made. It is intended that the scope of the invention is as defined in the appended claims and is not limited to the specific disclosed embodiments.

What is claimed is:

1. A collapsible display stand comprising:

a planar shelf forming an article support surface and a periphery comprising a front edge, two opposite side edges and a rear edge;

a front wall secured to and depending from the shelf front edge at a first hinge fold;

a rear wall upstanding from and secured to the shelf rear edge at a second hinge fold; and a pair of like spaced side walls each secured to the front wall and releasably secured to the rear wall, the side walls and front wall forming a support for the shelf and rear wall, the side walls and front wall each having a lower edge distal the shelf forming a support plane wherein the shelf and rear wall are spaced from the plane;

the front wall having opposing edges at opposite ends of the shelf front edge, each side wall corresponding to a different shelf side edge and being secured to a different one of the front wall opposing edges at a corresponding third hinge fold and having a broad surface abutting the shelf at a shelf side edge between the shelf rear and front edges;

each side wall extending from the support plane to a region above the shelf article support surface to form opposite side walls for the article support surface;

the side walls each comprising an inner planar member and an outer planar member joined at a fourth hinge fold extending between the first fold and the rear wall and located in the region above the support surface.

2. The stand of claim 1 wherein the stand includes interlock means for releasably interlocking the side walls to the rear wall.

3. The stand of claim 2 wherein the interlock means comprise a first slot in each of the side walls, the rear wall having a pair of spaced second slots, each said first slot being engaged with a different second slot to interlock each side wall to the rear wall, the slots and side walls being oriented to support the rear wall at the support plane.

4. The stand of claim 1 wherein the rear wall includes a plurality of article support peg receiving apertures.

5. The stand of claim 1 wherein the rear wall comprises a front sheet member and an overlying rear sheet member secured to the front sheet member, said front sheet member having a plurality of said apertures therethrough, the rear sheet member having a slot therethrough aligned with said apertures, said slot permitting the insertion of a peg through an aperture and through the slot wherein the front and rear sheet members provide support for the inserted article support peg.

6. The stand of claim 4 wherein the rear wall comprises front and rear overlying bonded together sheet members, the front sheet member having said apertures for supporting inserted article support pegs, the rear sheet member including means for providing further support for article support pegs inserted through the apertures.

7. The stand of claim 6 wherein the rear sheet member comprises two coplanar sheets secured to the front sheet member at respective corresponding hinge folds.

8. The stand of claim 1 having a plurality of linear arrays of peg receiving apertures in the rear wall.

9. The stand of claim 1 wherein the shelf, front, rear and side walls comprise a single sheet of foldable paperboard.

10. A collapsible display stand comprising:

a planar sheet member shelf having front, rear and opposite side edges;

a U-shaped sheet member including a base wall and two spaced opposing leg walls extending from the base wall, the base and leg walls each having a first edge, the first edges being coplanar;

means for securing the base wall at a second edge thereof to and depending from the shelf at the front edge with the base wall broad surface transverse the shelf broad surface and the leg walls each abutting a different shelf side edge;

a planar sheet member rear wall upstanding from the shelf rear edge such that the rear wall and base wall extend from the shelf in opposite directions; and means for securing the leg walls at an end distal the base wall to the rear wall such that the first edges form a support plane for the shelf and rear wall;

the means for securing including interlock means in said leg walls and in said rear wall for releasably securing the rear wall to the leg walls;

the leg walls being mirror images and each comprising a folded over sheet at a hinge fold and forming two overlaying layers with the fold extending at an acute angle with the planes of the shelf and rear wall.

11. The stand of claim 10 wherein the interlock means comprises a slot in each of the leg walls and a mating slot for each leg slot in the rear wall.

12. The stand of claim 10 wherein the folded over sheet forms inner and an outer walls, the inner wall being triangular.

13. The stand of claim 10 wherein the rear wall includes a plurality of article support peg receiving apertures.

14. The stand of claim 13 wherein the rear wall comprises a front sheet member and an overlying rear sheet member secured to the front sheet member, said front member having a plurality of said apertures therethrough, the rear sheet member having a slot therethrough aligned with said apertures, said slot permitting the insertion of a peg through an aperture and through the slot wherein the rear wall at the slot provides support for inserted peg.

15. The stand of claim 10 wherein all said sheet members comprise a single homogeneous sheet of paperboard wherein the base wall and rear walls are secured to the shelf at respective hinge folds and the leg walls are secured to the base wall at respective hinge folds.

16. A pegboard display comprising:

a first sheet member with an array of peg receiving apertures therethrough, each aperture for receiving a peg; and a second sheet member secured to and overlying the first sheet member, the second sheet member having a slot therethrough aligned with the array of peg receiving apertures for receiving the inserted pegs of said array.

17. The display of claim 16 including a plurality of said arrays and aligned slots.

18. The display of claim 17 including a shelf and a U-shaped member having a front and spaced side walls, the shelf being secured to an edge of the front wall, the first and second sheet members being secured to the shelf at a shelf edge distal the front wall and being secured to the side walls adjacent to the shelf distal edge.

19. A collapsible display stand comprising:

a shelf forming an article support surface and a periphery comprising a front edge, two opposite side edges and a rear edge;

a front wall secured to and depending from the shelf front edge at a first hinge fold;

a rear wall upstanding from and secured to the shelf rear edge at a second hinge fold; and a pair of like spaced side walls each secured to the front wall at a third hinge fold and releasable secured to the rear wall, the side walls and front wall forming a support for the shelf and rear wall, the side walls and front wall each having a lower edge distal the shelf forming a support plane wherein the shelf and rear wall are spaced from the plane;

the side walls each comprising an inner planar member and an outer planar member joined at a fourth hinge fold extending between the first fold and the rear wall and located in the region above the support surface.

20. A collapsible display stand comprising:

a planar shelf forming an article support surface and a periphery comprising a front edge, two opposite side edges and a rear edge;

a front wall secured to and depending from the shelf front edge at a first hinge fold;

a rear wall upstanding from and secured to the shelf rear edge at a second hinge fold; and a pair of like spaced side walls each secured to the front wall and releasably secured to the rear wall, the side walls and front wall forming a support for the shelf and rear wall, the side walls and front wall each having a lower edge distal the shelf forming a support plane wherein the shelf and rear wall are spaced from the plane;

the rear wall having a plurality of article support peg receiving apertures and comprising a front sheet member and an overlying rear sheet member secured to the front sheet member, said front sheet member having a plurality of said apertures therethrough, the rear sheet member having a slot therethrough aligned with said apertures, said slot permitting the insertion of a peg through an aperture and through the slot wherein the front and rear sheet members provide support for the inserted article support peg.

21. A collapsible display stand comprising:

a planar shelf forming an article support surface and a periphery comprising a front edge, two opposite side edges and a rear edge;

a front wall secured to and depending from the shelf front edge at a first hinge fold;

a rear wall upstanding from and secured to the shelf rear edge at a second hinge fold, said rear wall having a pair of spaced slots adjacent to said shelf rear edge, each slot at a corresponding rear wall bottom edge; and a pair of like spaced side walls each secured to the front wall, each side wall having a top edge with a slot therein for receiving a different rear wall slot to releasably secure the side walls to the rear wall at their respective top and bottom edges such that the rear wall upstands from and is supported by said side walls at said slots, the side walls forming the sole support for the shelf and rear wall at the rear wall, the side walls each having a lower edge distal the shelf forming a support plane wherein the shelf and rear wall are spaced from the plane.

22. A collapsible display stand comprising:

a planar sheet member shelf having front, rear and opposite side edges;

a U-shaped sheet member including a base wall and two spaced opposing leg walls extending from the base wall, the base and leg walls each having a first edge, the first edges being coplanar, the legs each having a top edge;

means for securing the base wall at a second edge thereof to and depending from the shelf at the front edge with the base wall broad surface transverse the shelf broad surface and the leg walls each abutting a different shelf side edge;

a planar sheet member rear wall upstanding from the shelf rear edge such that the rear wall and base wall extend from the shelf in opposite directions, said rear wall having a pair of bottom edges; and a slot in each leg wall in communication with its top edge and a pair of slots in communication with at least one bottom edge of the rear wall, a slot in each leg wall inter engaging a slot in the rear wall for securing the leg walls at a leg end distal the base wall to the rear wall such that the first edges form a support plane for the shelf and rear wall spaced from the shelf.

23. A collapsible display stand comprising:

a pair of like single layer sheet material side walls each having a bottom portion with a bottom edge for supporting the display and an integral top portion;

a shelf secured between the side walls spaced from the bottom edge wherein the top portion is above the shelf and the bottom portion is below the shelf; and a rear display panel interlocked witch the side walls and upstanding above the shelf, the rear display panel comprising a front sheet and a rear sheet, the front sheet having an array of discrete peg receiving apertures and the rear sheet having a slot aligned with the aperture array.

24. The stand of claim 23 wherein the top portion is triangular with a forward edge inclined toward the shelf, the top portion comprising a folded over double thickness of said sheet material.

* * * * *